US007544385B2

(12) United States Patent
Hänsel et al.

(10) Patent No.: US 7,544,385 B2
(45) Date of Patent: Jun. 9, 2009

(54) METHOD AND DEVICE FOR COATING ADHESIVE SURFACES OF FIXING ELEMENTS WITH A HOT-MELT ADHESIVE

(75) Inventors: Mathias Hänsel, Rümmingen (DE); Michel Bremont, Attenschwiller (FR)

(73) Assignee: A. Raymond & Cie., Grenoble (FR)

( * ) Notice: Subject to any disclaimer, the term of this patent is extended or adjusted under 35 U.S.C. 154(b) by 621 days.

(21) Appl. No.: 10/554,069

(22) PCT Filed: Jul. 9, 2004

(86) PCT No.: PCT/EP2004/007549

§ 371 (c)(1),
(2), (4) Date: Oct. 21, 2005

(87) PCT Pub. No.: WO2005/014749

PCT Pub. Date: Feb. 17, 2005

(65) Prior Publication Data

US 2006/0263517 A1 Nov. 23, 2006

(30) Foreign Application Priority Data

Jul. 22, 2003 (DE) ..... 103 33 152

(51) Int. Cl.
*B05D 1/12* (2006.01)
*B05D 3/12* (2006.01)
*B05D 5/10* (2006.01)
*B05C 11/02* (2006.01)

(52) U.S. Cl. ..... 427/197; 427/208.2; 427/370; 118/101

(58) Field of Classification Search ..... 427/208.2, 427/195, 197, 369, 370; 118/101–105, 126
See application file for complete search history.

(56) References Cited

U.S. PATENT DOCUMENTS

| | | | | |
|---|---|---|---|---|
| 4,262,038 | A * | 4/1981 | Wallace | 427/181 |
| 4,746,554 | A * | 5/1988 | Ecer | 427/191 |
| 5,756,185 | A | 5/1998 | Lesser | |
| 6,083,558 | A * | 7/2000 | Bremont | 427/195 |

FOREIGN PATENT DOCUMENTS

| | | |
|---|---|---|
| DE | 4402550 | 8/1995 |
| WO | WO 98/18612 | 5/1998 |

* cited by examiner

*Primary Examiner*—Frederick J Parker
(74) *Attorney, Agent, or Firm*—Tarolli, Sundheim, Covell & Tummino, LLP

(57) ABSTRACT

The invention relates to a method for coating adhesive surfaces of fixing elements with a hot-melt adhesive, and to a device for carrying out said coating method. Base surfaces (5) of recesses (2) are formed by tappets (6), whereby the lateral walls thereof are displacably guided in the recesses (2). A displaceable container (9) which is used to fill up the adhesive powder in the recesses (2) is arranged next to the recesses (2). The side edges (10) of the container (9) cover a working plate (1). A slit (11) which is used to receive the securing element (4) is arranged on the other side of the recesses (2), said slit being provided with continuous holes (12) for the tappets (6). A pressure stamp (13) provided with a pressure plate (14) which is lowered onto the securing element (4) is arranged over the recesses (2). A heating station (15) which is used to heat the securing element prior to heating the recesses (2) to the desired heating temperature is arranged at a distance from the slits (11).

5 Claims, 5 Drawing Sheets

FIG.7
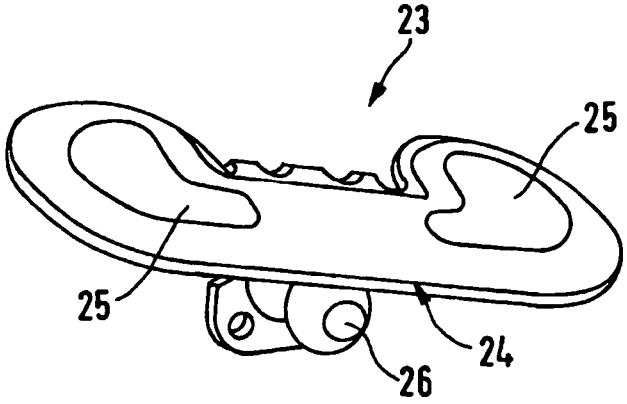
FIG.8
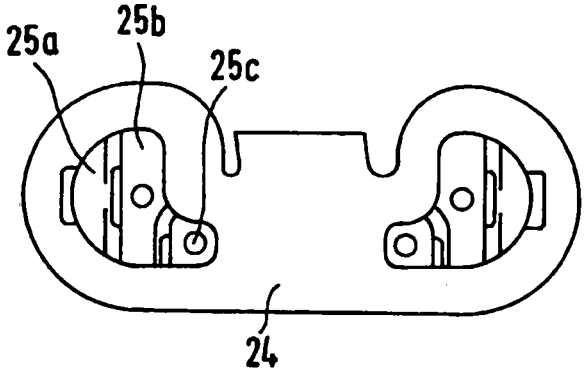
FIG.9
FIG.10
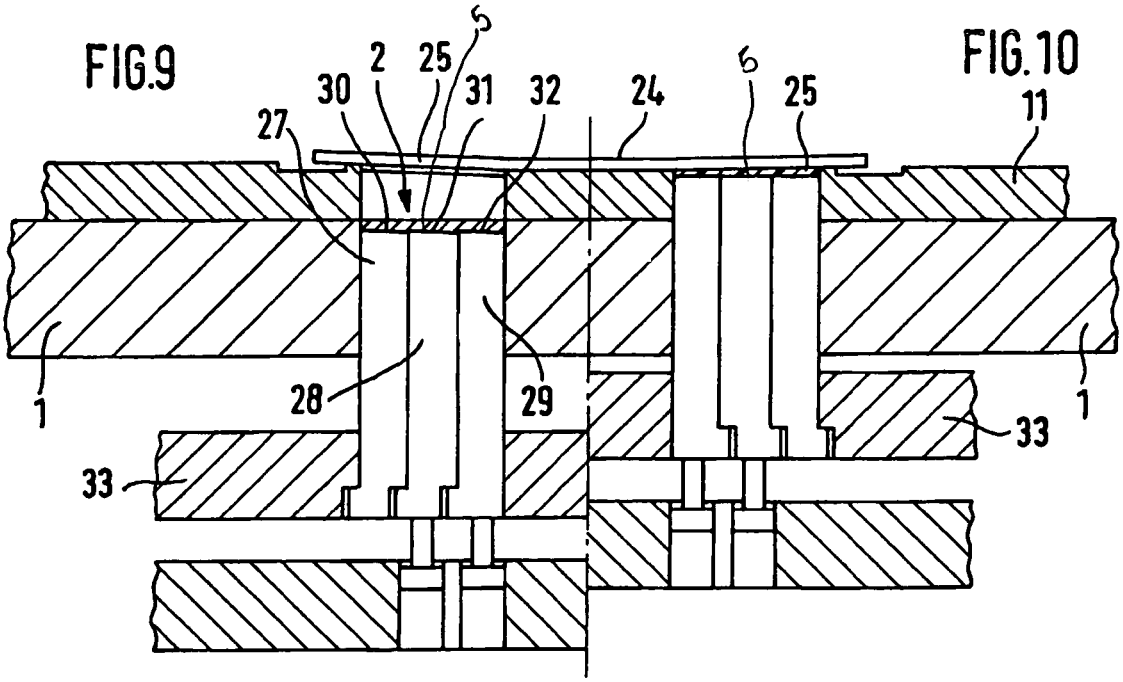

METHOD AND DEVICE FOR COATING ADHESIVE SURFACES OF FIXING ELEMENTS WITH A HOT-MELT ADHESIVE

TECHNICAL FIELD

The invention relates to a method for coating adhesive surfaces of fixing elements with a hot-melt adhesive and to a device for carrying out said method.

BACKGROUND OF THE INVENTION

This specifically involves the application of highly reactive hot-melt adhesives, which are designed to be wear-resistant and non-adhesive at temperatures up to 50° C., and which can be reactivated by means of heat or the supplying of another kind of energy in order to produce a permanent adhesive bond. In conjunction with that, the applied adhesive layer must be absolutely adhesion-proof or adhesion resistant until the component or carrier elements are used, and should not release the adhesive force inherent in the adhesive until the reactivating of the adhesive at the usage site.

It is already known from WO 98/18612 that for the coating of adhesive surfaces of fixing elements, the pre-mixed hot-melt adhesive in solid, preferably powder form, can be applied to the adhesive surface and can then be exposed to a thermal effect sufficient to adhere the adhesive by exerting a pressing force. Doing this depends on the fact that the full adhesive surface is coated with a uniformly thin layer and is then pressed with a stamp having a surface that is aligned absolutely parallel to the adhesive surface. This coating method is conceived more for the coating of small quantities, e.g., in an experimental laboratory, and is only designed for the coating of simply configured, flat adhesive surfaces such as the collar plates of fastening bolts.

The task of the invention is to make this known adhesive joining method usable for fixing elements with complex adhesive surfaces as well, and to develop a fully automatic method operation and to configure the device for carrying out this method in such a way that even fixing elements with uneven adhesive surfaces can be coated uniformly.

SUMMARY OF THE INVENTION

According to the present invention, this task is solved essentially through the following method steps:

The adhesive powder is first filled into recesses in a working plate having contours that correspond to the adhesive surface of the fixing element, and is then smoothed out in the desired thickness, after previously being heated in a heating station to the temperature required for adhesion, the fixing element is deposited over the recesses that have been filled with the powdered adhesive, the adhesive powder is then pressed against the adhesive surface from below by tappets having a cross section that is matched to the recesses and top sides that are matched to the geometry of the fixing element.

A device for carrying out the method according to the invention is characterized by the following features:

It possesses a working plate with recesses corresponding to the contours of the adhesive surface of the fixing element, the base surfaces of the recesses are formed by tappets, which have lateral walls that are displaceably guided within the recesses and the top side of which is matched in form to the geometry of the fixing element, arranged laterally to the recesses on the working plate is a horizontally displaceable container for filling the adhesive powder into the recesses, whereby the side edges of the container sweep flush over the working plate, arranged on the other side of the recesses is a sliding plate, also horizontally displaceable, which is used for receiving the fixing element and which is provided with continuous holes for the tappets that rise up from the working plate, arranged over the recesses is a vertically displaceable pressure stamp with a pressure plate that is lowered onto the fixing element, installed at a distance from the sliding plate is a heating station that brings the fixing elements to the desired heating temperature before they are transported over the recesses.

BRIEF DESCRIPTION OF THE DRAWINGS

Additional features of the invention can be found in the subclaims and in the following description of embodiments of the invention that are shown in the drawings. The following are shown:

DETAILED DESCRIPTION

Figure 1A:
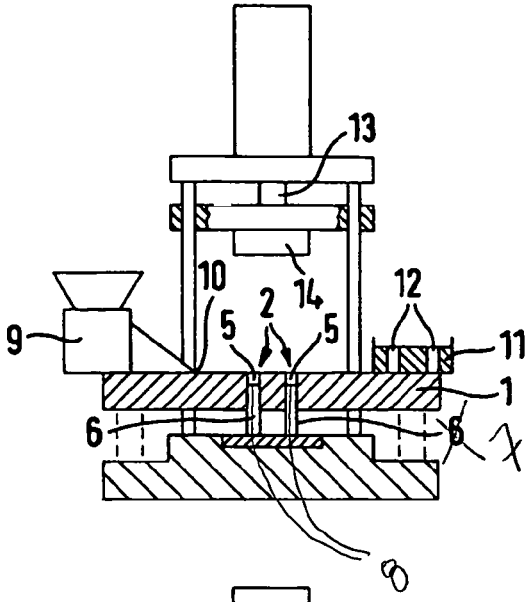
FIG. 1 The schematic representation of a device for carrying out the inventive coating a)-f) method with the successive method steps, FIG. 2 A perspective view of a holder for rain sensors with inventively coated hot-melt adhesive for adhesion onto an uneven windshield, FIG. 3 The bottom view of the same holder with a view towards the adhesive surfaces, FIG. 4 A section through the holder along the line IV-IV in FIG. 3, FIG. 5 The schematic representation of a section through the working plate, the sliding plate with an inserted holder per FIG. 4, and the hot-melt adhesive-filled recess before the tappets are raised, FIG. 6 The same section after the tappets have been raised, FIG. 7 A perspective view of a holder with a ball joint pivot for adhesion to an uneven automobile rear window, FIG. 8 The same holder in a bottom view with two broad adhesive surfaces, FIG. 9 A schematic representation of a section through the working plate, the sliding plate with an inserted holder, and the hot-melt adhesive-filled recess with three adjacent displaceable tappets before they are raised, and FIG. 10 The same sectional representation after the tappets have been raised.

The device shown in FIG. 1 is used for carrying out the inventive method for coating the adhesive surfaces of fixing or holding elements with hot-melt adhesive. It is comprised of a working plate 1 that is provided with recesses 2 corresponding to the contours of the adhesive surface 3 of the fixing element 4. In conjunction with that, the base surfaces 5 of the recesses 2 are formed by tappets 6, the lateral walls 7 of which are displaceably guided in the recesses 2. The top side 8 of the tappets 6 is matched in form to the adhesive surface 3 of the fixing element 4; this means that it is not only matched to the contours of the adhesive surfaces 3, but that it is also configured absolutely parallel to the adhesive surface 3.

Arranged laterally next to the recesses 2 on the working plate 1 is a container 9 for filling the adhesive powder into the recesses 2. This container 9 is guided in a horizontally displaceable manner on the working plate 1, whereby the side edges 10 of the container 9 sweep flush over the working plate 1.

In addition, arranged on the other side of the recesses 2 is a sliding plate 11 which is used for receiving the fixing or holding element 4 and which is also guided in a horizontally displaceable manner on the working plate 1 in the direction towards the recesses 2. In conjunction with that, the top side of this sliding plate 11 is matched in form to the geometry of the adhesive surfaces 3. This sliding plate 11 is provided with continuous holes 12 which are for the tappets 6 that rise up from the working plate 1 and the inner walls of which are also matched in form to the lateral walls 7 of the tappets 6.

Arranged over the recesses 2 is a vertically displaceable pressure stamp 13 with a pressure plate 14 that is lowered onto the fixing element 4 that has been inserted into the sliding plate 11. In addition, arranged at a distance from the sliding plate 11 is a heating station 15 that heats the fixing elements 4 to the desired melting temperature before they are transported over the recesses 2.

The operating sequence shown in FIGS. 1*a*) through *f*) can be described as follows:

FIG. 1*a*) The container 9 and the sliding plate 11 are located in their starting position next to the recess 2 on the working plate 1, the pressure plate 14 in its upper waiting position and the tappets 6 with their top sides 8 below the plate level.

Figure 1B:
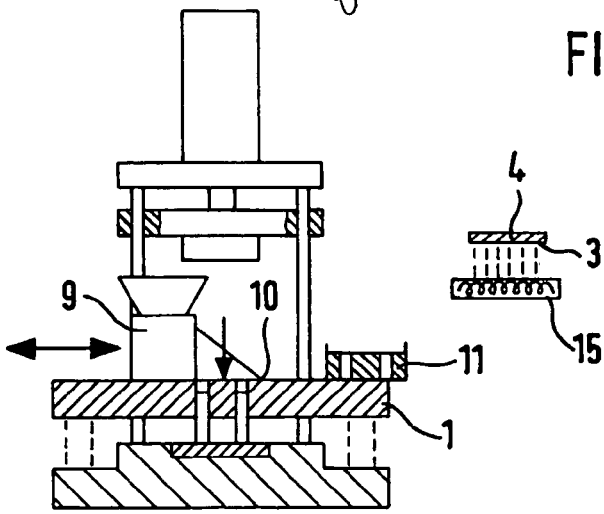

FIG. 1*b*) The fixing element 4 is located above the heating station 15, which is installed at a distance from the sliding plate 11, and is heated there to the desired melting temperature. At the same time, the container 9 with the powder adhesive is moved above the recesses 2 to the right in the direction of the arrow in order to fill them with powder. The container 9 is then moved back again, whereby the side edges 10 of the container 9 sweep flush over the working plate 1 and at this time draw the powder off into the recess 2 to the desired filling height.

Figure 1C:
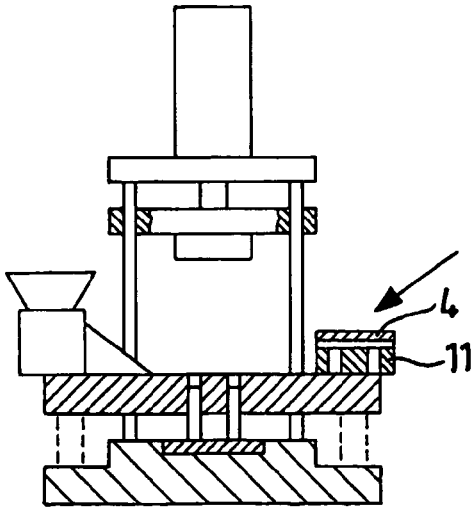

FIG. 1*c*) The preheated fixing element 4 is placed next to the recesses 2 on the sliding plate 11, the top side of which is matched in form to the geometry of the adhesive surface 3.

Figure 1D:
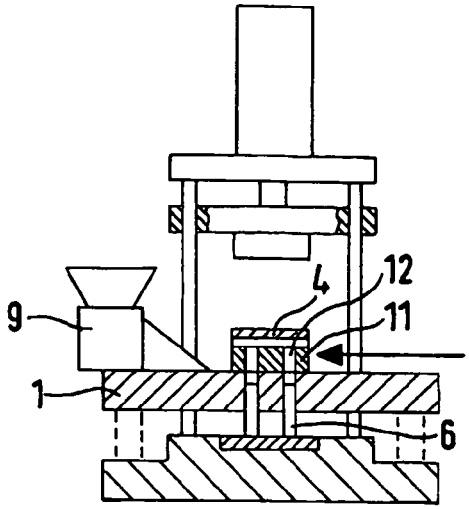

FIG. 1*d*) The sliding plate 11 with the inserted fixing element 4 is moved over the recesses 12, and specifically, in such a way that continuous holes 12 align with the tappets 6.

Figure 1E:
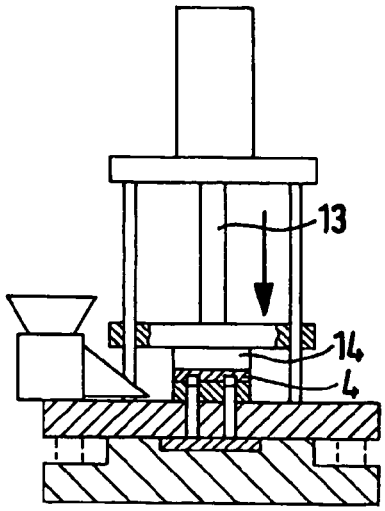

FIG. 1*e*) The pressure plate 14 is lowered onto the fixing element 4. At the same time, the tappets 6 are raised from below through the continuous holes 12, and the adhesive powder that has been prepared in the recesses 2 is pressed against the underside of the heated fixing element 4.

Figure 1F:
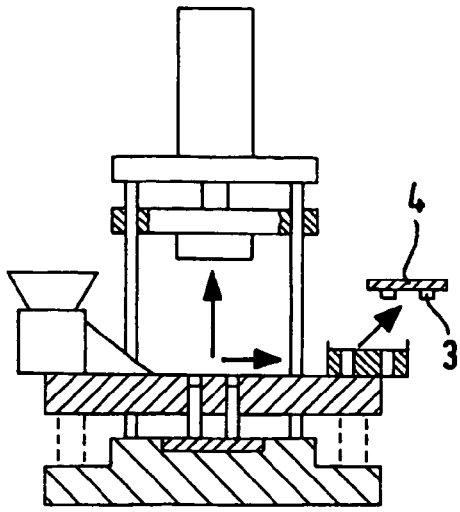

FIG. 1*f*) After the fixing element 4, preheated at the heating station, has been exposed to a thermal effect sufficient to adhere the adhesive, the pressure plate 14 is raised again and the sliding plate 11 is moved back to the side. The coated fixing element 4 can then be lifted from the sliding plate 11 and stored in a container, not shown in the drawing.

Figure 2:
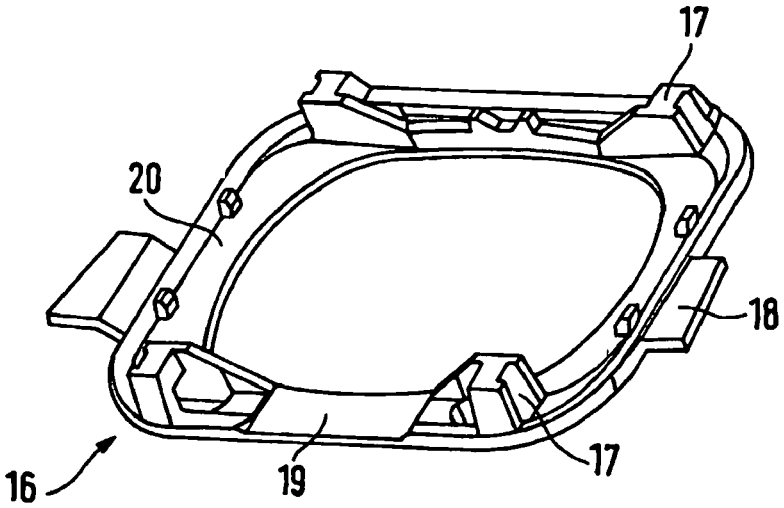
Figure 3:
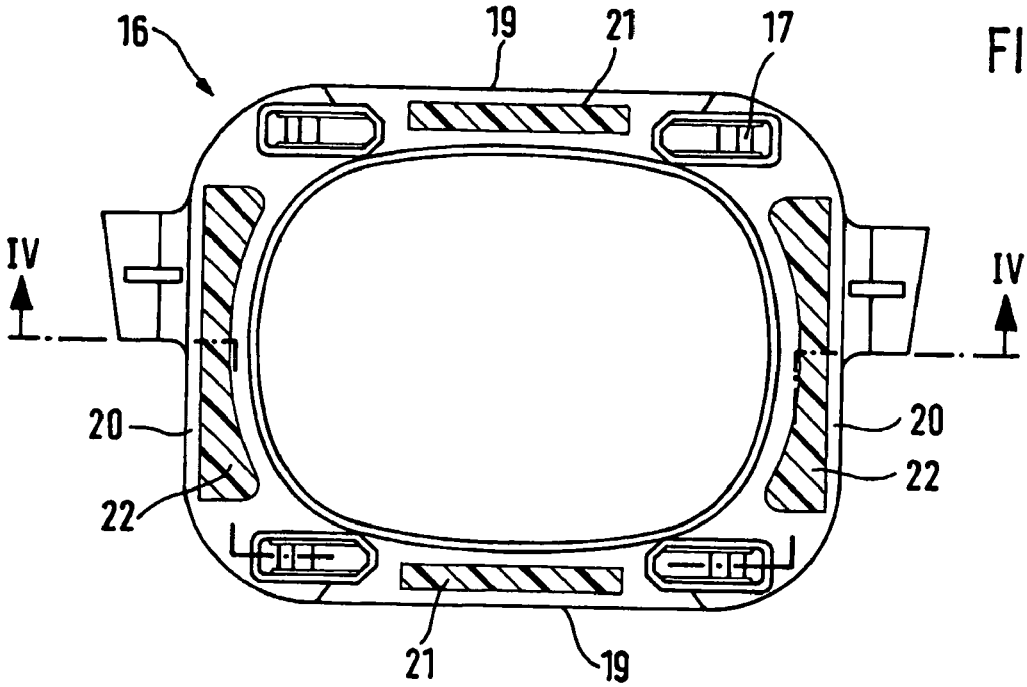
Figure 4:
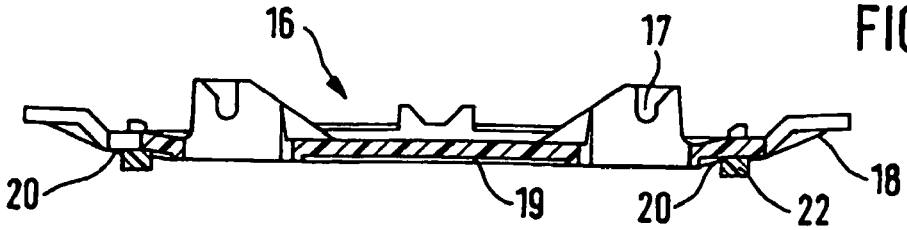

The fixing element shown in FIGS. 2 through 4 is a holder for rain sensors that are to be adhered to uneven windshields. This holder is comprised of a rectangular frame 16 with fastening locations 17 for the sensors, not shown, formed onto the four corners, and two laterally opposed projecting holding tabs 18 for gripping the frame 16. Provided on the underside of the frame 16 on the longitudinal sides 19 and transverse sides 20 are adhesive surfaces 21 and 22, which are coated with a thin layer of hot-melt adhesive in accordance with the invention.

Figure 5:
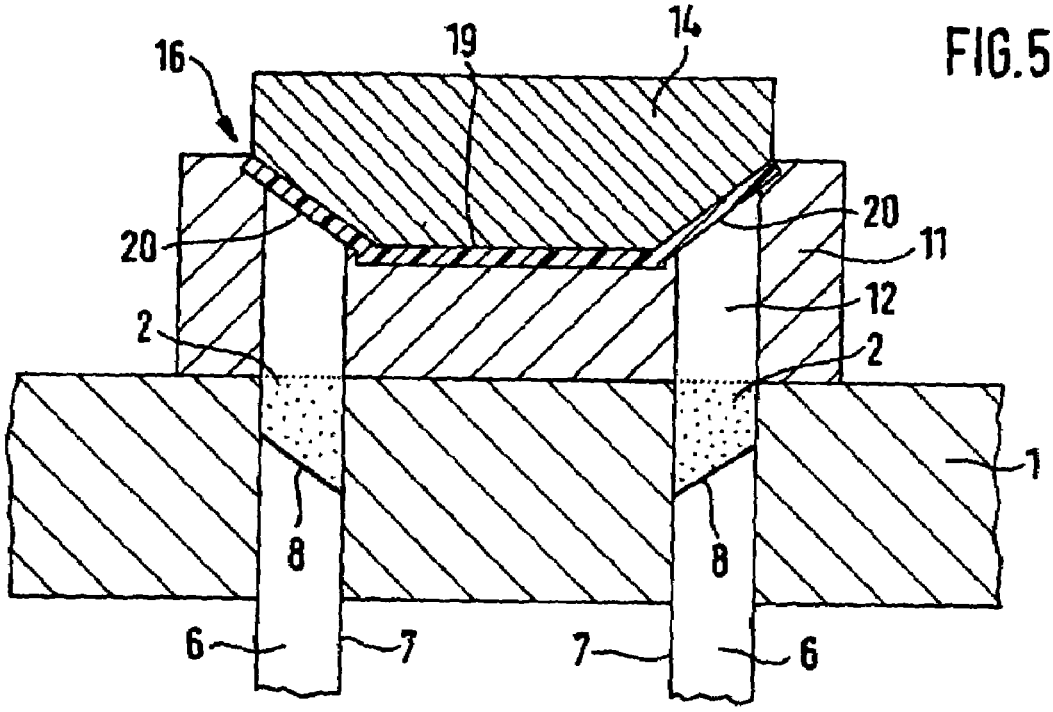

FIG. 5 shows a schematic representation of the frame 16 of the holder shown in FIGS. 2 through 4 lying on the sliding plate 11, with horizontal longitudinal sides 19 and, at an angle to same, transverse sides 20, which are located above the recesses 2 and the continuous holes 12 and which are pressed down onto the sliding plate 11 from above by the pressure plate 14. In conjunction with that, the recesses 2 have previously been filled with adhesive powder from the container 9 on the top side 8 of the tappet 6 and then swept smooth to the level of the surface of the working plate 1 by the side edge 10 of the container 9.

Figure 6:
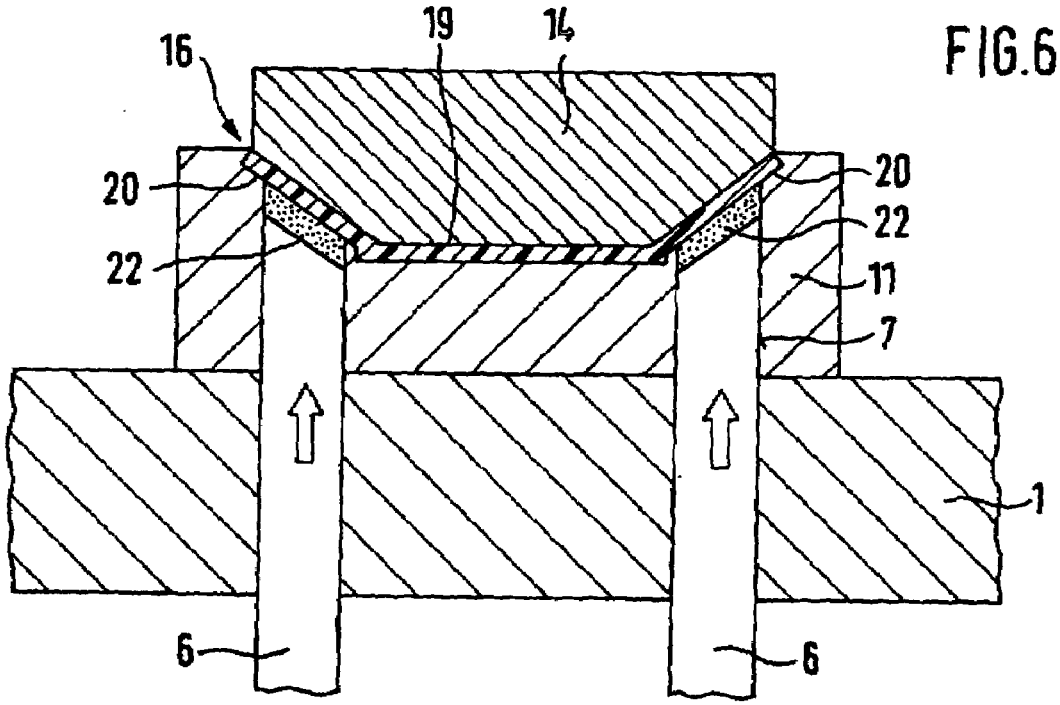

In the same schematic representation, FIG. 6 shows the way in which the adhesive powder is pressed and compressed plane-parallel against the adhesive surfaces 22 of the transverse sides 20 by the tappets 6 after they have been raised, until the powder has melted as a result of the contact with the preheated frame 16 and adheres to the adhesives surfaces 22 as a result of the pressing force generated by the tappets 6.

The embodiment represented in FIGS. 7 through 10 shows another holder with a ball pivot 26 to be adhered to the uneven surface of an automobile rear window. In this regard, the ball pivot 26 is used to bear a so-called gas spring which is borne at the other end on the window frame and which supports the rear window after it has been swung up. This holder is comprised of a kidney-shaped base plate 23 with an angled ball pivot 26 at the central plate section 24, and adhesive powder-coated, broad adhesive surfaces 25 configured on the opposing ends. The latter are inclined at a slight angle to the central plate section 24, and are matched to the rear window surface which is inclined at the same angle.

As can be seen from the schematic representation of a section through the working plate 1 in FIGS. 9 and 10, each of the base surfaces 5 of the recesses 2 in the present embodiment is formed by three tappets 27, 28 and 29 in the working plate 1, which are displaceable relative to one another and which are held by a tappet retaining plate 33. In conjunction with this, the top sides 30, 31 and 32 of each tappet 27, 28 and 29 are matched in form to the particular associated partial areas 25*a*), 25*b*) and 25*c*) of the adhesive surfaces 25.

In the starting position shown in FIG. 9, the top sides 30, 31 and 32 of the tappets 27, 28 and 29 form three levels that are stepped relative to one another, whereby the particular upper ends of the top sides lie at the same height. What is accomplished by doing this is that in the starting position, the layer thickness of the filled adhesive powder fluctuates only slightly over the width of the tappets 27, 28 and 29.

FIG. 10 shows the same sectional representation after the tappets 27, 28 and 29 have been raised. In conjunction with this, the difference in levels among the tappet top sides 30, 31 or 32 is compensated for through the fact that the tappets are slightly staggered relative to one another until they all lie in a single plane against the adhesive surfaces 25 *a*), *b*) and *c*) so that a uniformly thick layer of adhesive powder is applied compressed onto the adhesive surface 25.

The invention claimed is:

1. Method for coating surfaces for fixing elements with hot-melt adhesive powder, whereby the pre-mixed adhesive in pulverized form is applied to the surfaces and is exposed to a thermal effect sufficient to adhere the adhesive to the surfaces by exerting a pressing force upon the adhesive, characterized in that the adhesive powder is filled into recesses in a working plate having contours that correspond to the surfaces of the element, and is then smoothed out in the desired thickness, the element, after being heated to the temperature required for adhesion of the adhesive powder to the surfaces, is positioned over the recesses that have been filled with the powdered adhesive, the adhesive powder is then pressed against the surfaces from below by tappets having a cross section that is matched to the recesses and top sides that are matched to the geometry of the surfaces.

2. Device for carrying out the coating method according to claim 1, comprised of a working plate (1) with recesses (2) corresponding to the contours of the surface (3) of the element (4), whereby the base surfaces (5) of the recesses (2) are formed by tappets (6), which have lateral walls (7) that are displaceably guided within the recesses (2) and the top sides (8) of which are matched in form to the geometry of the surfaces (3), arranged laterally on the working plate (1), a horizontally displaceable container (9) for filling the adhesive powder into the recesses (2), whereby the side edges (10) of the container (9) sweep flush over the working plate (1), arranged on the other side of the recesses (2), a sliding plate (11), also horizontally displaceable, which is used for receiving the element (4) and which is provided with continuous holes (12) which are for the tappets (6) that rise up from the working plate (1) and the inner walls of which are matched to the lateral walls (7) of the tappets (6), arranged over the recesses (2), a vertically displaceable pressure stamp (13) with a pressure plate (14) that is lowered onto the element (4), and, installed at a distance from the sliding plate (11), a heating station (15) for heating the elements (4) to the desired heating temperature before they are transported over the recesses (2).

3. Device for carrying out the coating method according to claim 2, whereby the element is comprised of a base plate (23) with surfaces (25) of greater width configured on both sides of the central plate section (24), and these surfaces (25) exhibit a geometry that differs from that of the central plate section (24), characterized in that each of the base surfaces (5) of the recess (2) is formed by two or more tappets (27), (28) and (29) which are displaceable relative to one another, whereby the top sides (30) (31) (32) of each tappet (27) (28) (29) are matched in form to the particular associated geometry of the partial areas (25*a*) (25*b*) (25*c*) of the surfaces (25).

4. Device for carrying out the coating method according to claim 2, characterized in that the top side of the sliding plate (11) is matched in form to the geometry of the surfaces (3), (21 and 22) and (25).

5. Device for carrying out the coating method according to claim 3, characterized in that the top side of the sliding plate (11) is matched in form to the geometry of the surfaces (3), (21 and 22) and (25).

* * * * *